US005456769A

United States Patent [19]

Sakurada et al.

[11] Patent Number: 5,456,769

[45] Date of Patent: Oct. 10, 1995

[54] MAGNETIC MATERIAL

[75] Inventors: Shinya Sakurada, Yokohama; Takahiro Hirai, Kamakura; Akihiko Tsutai, Kawasaki, all of Japan

[73] Assignee: Kabushiki Kaisha Toshiba, Kawasaki, Japan

[21] Appl. No.: 203,371

[22] Filed: Mar. 1, 1994

[30] Foreign Application Priority Data

Mar. 10, 1993 [JP] Japan ..... 5-048890

[51] Int. Cl.[6] ..... H01F 1/055

[52] U.S. Cl. ..... 148/301; 148/303

[58] Field of Search ..... 148/301, 303

[56] References Cited

U.S. PATENT DOCUMENTS

| | | | |
|---|---|---|---|
| 4,484,957 | 11/1984 | Higuchi et al. | 148/303 |
| 4,971,637 | 11/1990 | Ohashi et al. | 148/301 |
| 5,186,766 | 2/1993 | Iriyama et al. | 148/301 |

FOREIGN PATENT DOCUMENTS

| | | | |
|---|---|---|---|
| 53-131222 | 11/1978 | Japan . | |
| 60-244003 | 12/1985 | Japan . | |
| 61-10209 | 1/1986 | Japan . | |
| 2-192102 | 7/1990 | Japan . | |
| 2-294447 | 12/1990 | Japan . | |
| 3-16102 | 1/1991 | Japan . | |
| 4-323802 | 11/1992 | Japan | 148/303 |
| 4-323801 | 11/1992 | Japan | 148/303 |

OTHER PUBLICATIONS

J. Appl. Phys. 70(6), M. Katter, et al., "Structural and Hard Magnetic Properties of Rapidly Solidified Sm–Fe–N", pp. 3188–3196, Jun. 19, 1991.

*Primary Examiner*—George Wyszomierski

*Attorney, Agent, or Firm*—Oblon, Spivak, McClelland, Maier, & Neustadt

[57] ABSTRACT

Disclosed is a magnetic material which exhibits an improved saturation magnetic flux density and an improved magnetic anisotropy and, thus, is adapted for use as a raw material of a permanent magnet or a bond magnet of a high performance. The magnetic material is represented by a general formula $$R_xCo_yFe_{100-x-y} \quad (I)$$

where R is at least one element selected from the rare earth elements, x and y are atomic percent individually defined as $4 \leqq x \leqq 20$ and $0.01 \leqq y \leqq 70$, and Co and Fe occupy 90 atomic percent or more in the principal phase of the compound, and the principal phase has a $TbCu_7$ crystal structure.

19 Claims, 1 Drawing Sheet

MAGNETIC MATERIAL

BACKGROUND OF THE INVENTION 1. Field of the Invention

The present invention relates to a magnetic material, particularly, to a magnetic material useful as a raw material of a permanent magnet.

2. Description of the Related Art

As high performance rare earth permanent magnets, hitherto, a Sm—Co system magnet and a Nd—Fe—B system magnet are known and their mass production is currently on a sharp increase. These magnets contain Fe and Co at high concentrations and they contribute to the promotion in the level of the saturation magnetic flux density (Bs). These magnets also contain rare earth elements such as Nd and Sm, and the rare earth elements bring about a very large magnetic anisotropy derived from the behavior of 4f electrons in the crystal field. As a result, the coercive force ($iH_c$) is increased, and a magnet of high performance is realized. Such high performance magnets are mainly used in electric appliances such as loudspeakers, motors and instruments.

On the other hand, a great demand has arisen recently for down-sized electronic appliances and efforts have been required to provide permanent magnets of even higher performance that can be realized by improving the maximum energy product [$(BH)_{max}$] of a permanent magnet.

SUMMARY OF THE INVENTION

An object of the present invention is to provide a magnetic material having a high saturation magnetic flux density and excellent in magnetic anisotropy.

Another object is to provide a magnetic material which permits improving the saturation magnetic flux density, the magnetic anisotropy and the Curie temperature of the permanent magnet and is excellent in the magnetic properties.

According to a first aspect of the present invention, there is provided a magnetic material which is represented by a general formula:

$$R_xCo_yFe_{100-x-y} \quad (I)$$

where R is at least one element selected from the rare earth elements, x and y are atomic percent individually defined as $4 \leqq x \leqq 20$ and $0.01 \leqq y \leqq 70$, and Co and Fe occupy 90 atomic percent or more in the principal phase of the compound.

According to a second aspect of the present invention, there is provided a magnetic material which is represented by a general formula:

$$R_xA_zCo_yFe_{100-x-y-z} \quad (II)$$

where R is at least one element selected from the rare earth elements; A is at least one element selected from H, N, C and P; x, y and z are atomic percent individually defined as $4 \leqq x \leqq 20$, $0.01 \leqq y \leqq 20$, $z \leqq 20$; and Co and Fe occupy 90 atomic percent or more of all the elements except A in the principal phase of the compound.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWING

The accompanying drawing, which is incorporated in and constitutes a part of the specification, illustrates presently preferred embodiments of the invention and, together with the general description given above and the detailed description of the preferred embodiments given below, serves to explain the principles of the invention.

DETAILED DESCRIPTION OF THE PREFERRED EMBODIMENTS

Figure 1:
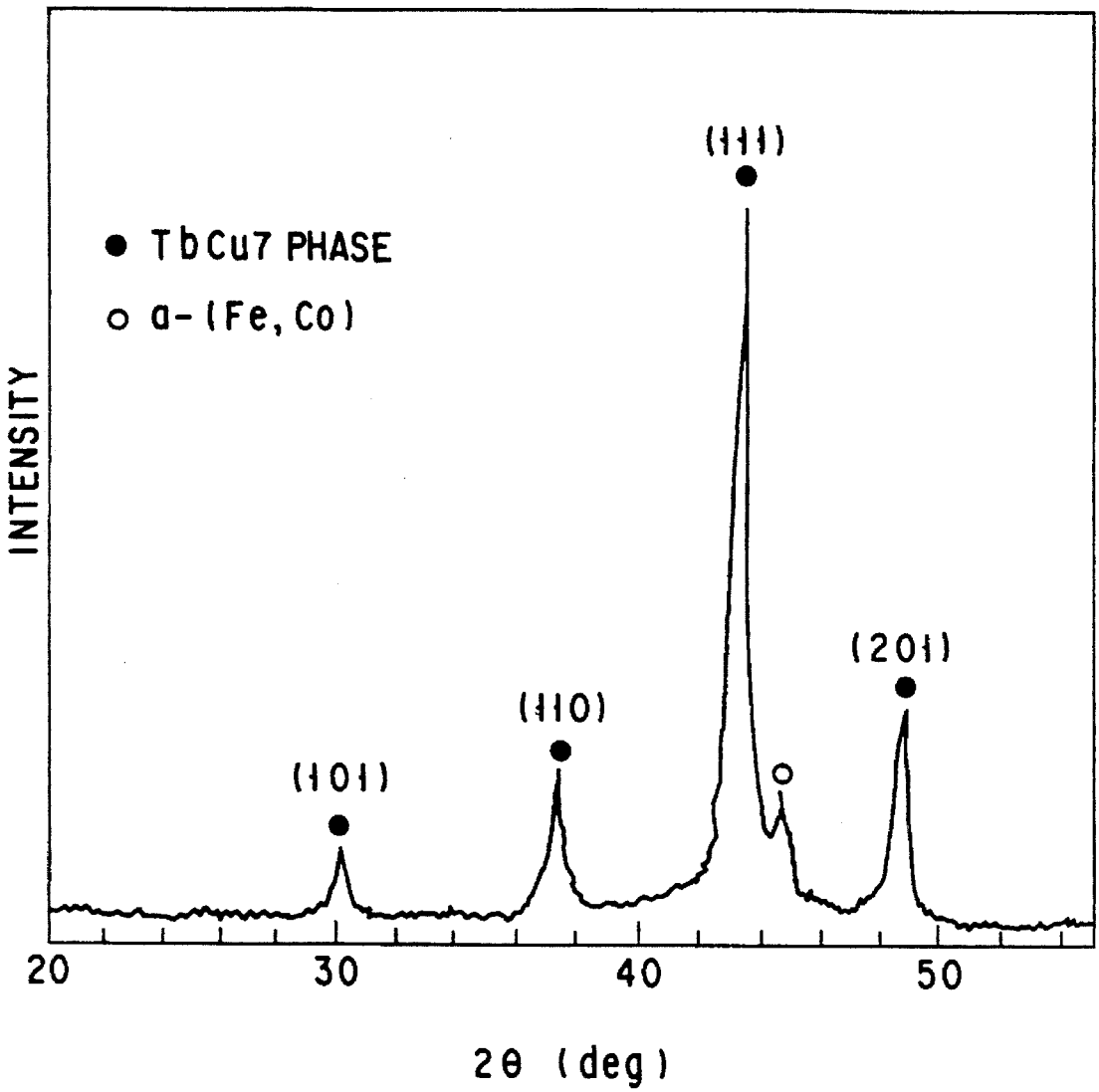
FIG. 1 is a graph showing a typical X-ray diffraction pattern of a magnetic material with a principal phase having a $TaCu_7$ crystal structure according to the present invention.

A magnetic material according to one aspect of the present invention is represented by a general formula:

$$R_xCo_yFe_{100-x-y} \quad (I)$$

where R is at least one element selected from the rare earth elements, x and y are atomic percent individually defined as $4 \leqq x \leqq 20$ and $0.01 \leqq y \leqq 70$, and Co and Fe occupy 90 atomic percent or more in the principal phase of the compound.

The term "principal phase" noted above denotes one of the crystal phases and amorphous phase in the compound which occupies the largest volume. It is desirable for the principal phase to have a uniaxial crystal structure such as a hexagonal or tetragonal system. Particularly, the principal phase should desirably have a $TbCu_7$ crystal structure.

FIGURE shows a typical X-ray diffraction pattern of a magnetic material having a $TbCu_7$ crystal structure as the principal phase obtained by using Cu—Kα radiation. As seen from FIGURE, the diffraction angle 2θ has peak levels that appear somewhere around 30°, 37°, 43°, 45° and 49° if taken between 20° and 55°. Of the peaks, the one appearing around 45° may be attributable to the reflection of X-rays by α-Fe (or α-Fe, Co) existing in the magnetic material. All the remaining peaks are indexed in terms of $TbCu_7$ crystal structure.

The magnetic material of the present invention comprises a rare earth element R, Co and Fe as apparent from the general formulas referred to previously. The element R used in the present invention includes La, Ce, Pr, Nd, Sm, Eu, Gd, Tb, Dy, Ho, Er, Tm, Yb, Lu and Y. These rare earth elements can be used singly or in the form of a mixture of at least two of these rare earth elements. The element R, which should be contained in an amount of 4 to 20 atomic percent, serves to bring about a large magnetic anisotropy in the magnetic material so as to impart a high coercive force to the magnetic material. If the amount of the element R contained in the magnetic material is smaller than 4 atomic percent, a large amount of α-(Fe, Co) is formed in the magnetic material, resulting in failure to obtain a large coercive force. If the element R exceeds 20 atomic percent, the saturation magnetic flux density of the magnetic material is markedly lowered. Preferably, the amount of the element R contained in the magnetic material should fall within a range of between 4 and 16 atomic percent.

Cobalt, which is contained in an amount of 0.01 to 70 atomic percent, serves to increase the Fe and Co concentrations in the principal phase of the magnetic material. The magnetic material containing Co exhibits a further increased saturation magnetic flux density, compared with the magnetic material which does not contain Co. Also, Co serves to improve the thermal stability of the principal phase. If the amount of Co contained in the magnetic material is smaller than 0.01 atomic percent, it is impossible to obtain the effects noted above sufficiently. On the other hand, the Co content exceeding 70 atomic percent leads to a lowered saturation magnetic flux density of the magnetic material. Preferably, Co should be contained in an amount of 4 to 40 atomic percent, more preferably, 10 to 40 atomic percent.

Iron contained in the magnetic material of the present invention serves to increase the saturation magnetic flux density of the magnetic material. Particularly, the magnetic material containing at least 70 atomic percent of Fe exhibits a markedly increased saturation magnetic flux density.

In the present invention, Fe may partly be replaced by an element M which represents at least one element selected from the group consisting of Ti, Cr, V, Mo, W, Mn, Ni, Sn, Ga, Al, Ag, Cu, Zn, Nb and Ta. Where Fe is partly replaced by the element M, the principal phase is allowed to occupy a greater portion of the magnetic material. Further, the total concentration of Fe, Co and the element M in the principal phase is also increased. It should be noted, however, that, if the amount of the element M partly replacing Fe is unduly large, the saturation magnetic flux density is lowered in the resultant magnetic material. To avoid the problem, it is desirable for the replacing amount of the element M not to exceed 20 atomic percent of the Fe amount.

The principal phase of the magnetic material should contain Co and Fe. The total amount of these Co and Fe should be at least 90 atomic percent of the principal phase. If the amount noted above is less than 90 atomic percent, it is impossible to obtain a magnetic material having a large saturation magnetic flux density. Particularly, the amount of Fe should be at least 25 atomic percent, preferably at least 50 atomic percent, and more preferably 60 to 80 atomic percent, based on the sum of Co and Fe. A magnetic material, in which Fe is contained in such a large amount in the principal phase, exhibits a further increased saturation magnetic flux density.

It is unavoidable for the magnetic material of the present invention to contain traces of impurities such as oxides. Needless to say, however, the magnetic material containing such unavoidable impurities falls within the technical scope of the present invention.

The magnetic material represented by general formula (I) can be manufactured by, for example, the method described below. In the first step, a mixture consisting of predetermined amounts of the element R, Co, Fe and the element M partly replacing Fe is melted by an arc or high frequency heating to prepare a molten alloy. Then, the resultant melt is sprayed onto a single or twin roll rotating at a high speed so as to rapidly cool the melt. The rapid cooling process which can be employed in the present invention also includes, for example, a rotary disc method in which the melt is sprayed onto a rotating disc for the rapid cooling of the melt, and a gas atomizing method in which the melt is sprayed into an inert gas such as He for the rapid cooling of the melt. It is desirable for the rapid cooling process to be carried out under an inert gas atmosphere such as Ar or He in order to prevent the magnetic characteristics of the resultant magnetic material from being deteriorated by oxidation accompanying the rapid cooling process.

It is also possible to employ a mechanical alloying method or a mechanical grinding method, in which a mechanical energy is imparted to the mixture of the starting materials noted above for alloying the mixture. In each of these methods, the mixture is subjected to a solid phase reaction for the alloying. For carrying out the solid phase reaction, the mixture is put in, for example, a planetary ball mill, a rotary ball mill, an attritor, a vibrating ball mill, or a screw type ball mill, so as to give a mechanical impact to the mixture.

Further, the magnetic material represented by general formula (I) can also be manufactured by casting the molten material prepared by the arc or high frequency heating.

A powdery magnetic material is obtained by pulverizing the alloy prepared by the methods described above in, for example, a ball mill, a brown mill or a stamp mill. Incidentally, the alloy prepared by the mechanical alloying method or the mechanical grinding method is already powdery and, thus, the pulverizing step can be omitted in this case.

The powdery magnetic material represented by general formula (I) is subjected to a hot pressing or a hot isostatic pressing (HIP) to obtain a molded body of a high density which is used as a permanent magnet. A permanent magnet having a high magnetic flux density can be obtained by applying a magnetic field in the pressing step noted above so as to align the crystal directions of the shaped body. On the other hand, a permanent magnet with a magnetic orientation in the direction of the axis of easy magnetization can be obtained by applying a plastic deforming treatment under pressure at 300° to 1000° C. after the shaping step by the hot pressing or HIP.

A permanent magnet can also be obtained by sintering the powdery magnetic material.

On the other hand, a bond magnet is manufactured by mixing the powdery magnetic material with a resin such as an epoxy resin or nylon, followed by shaping the resultant mixture. In the case of using a thermosetting resin such as an epoxy resin, it is desirable to apply a curing treatment at 100° to 200° C. to molded body. It is desirable to employ an injection molding method in the case of using a thermoplastic resin such as nylon.

Further, a metal bond magnet is manufactured by mixing first the powdery magnetic material of the present invention with a metal or alloy having a low melting point.

The magnetic material of the present invention described above is represented by general formula (I), i.e., $[R_xCo_yFe_{100-x-y}]$. What should also be noted is that at least 90 atomic percent of the principal phase of the magnetic material is occupied by Fe and Co. The magnetic material of the particular construction exhibits a high saturation magnetic flux density and is excellent in its magnetic anisotropy.

Particularly, the magnetic material, in which the principal phase is indexed by the $TbCu_7$ crystal structure and contains at least 90 atomic percent of Fe and Co which is larger than the stoichiometric amount, exhibits a further increased saturation magnetic flux density and a markedly improved maximum energy product $[(BH)_{max}]$.

To be more specific, the amounts of Fe and Co contained in the $TbCu_7$ phase are deeply related to the ratio of the lattice constants c to a of the phase, i.e., the ratio c/a. Examples of crystal structures having a crystal structure that resembles the crystal structure of a magnetic material of the present invention include the $Th_2Zn_{17}$ crystal structure and the $ThMn_{12}$ crystal structure. The lattice constants a and c of the $Th_2Zn_{17}$ crystal structure and the $ThMn_{12}$ crystal structure can be transformed to that of the $TbCu_7$ crystal structure by using the formulas given below:

$$\begin{cases} a(TbCu_7) = c(ThMn_{12}) \\ c(TbCu_7) = a(ThMn_{12})/2 \end{cases}$$

$$\begin{cases} a(TbCu_7) = [a(Th_2Zn_{17})]/(3^{1/2}) \\ c(TbCu_7) = c(Th_2Zn_{17})]/3 \end{cases}$$

Thus, the ratio of lattice constants can be expressed as $c(TbCu_7)/a(TbCu_7)$ [hereinafter referred to as c/a] in terms of the ($TbCu_7$) crystal structure. It follows that the known magnetic materials exemplified above are expressed as follows by using the ratio c/a.

$Th_2Zn_{17}$ crystal structure . . . c/a: about 0.84

$ThMn_{12}$ crystal structure . . . c/a: about 0.88

Suppose the composition of the principal phase in question is represented by $RT_w$ (where R denotes a rare earth element and T represents the sum of Fe and Co). If the $Th_2Zn_{17}$ crystal structure and the $ThMn_{12}$ crystal structure given above are defined to be as shown in formulas (1) and (2) given below, respectively, the relationship between the ratio c/a and w can be represented by formula (3) given below:

$$c/a\text{: about } .84 \rightarrow w=.5 \quad (1)$$

$$c/a\text{: about } .88 \rightarrow w=12 \quad (2)$$

$$w=(5+2d)/(1-d) \quad (3)$$

"d" in formula (3) is: $d=(25/6)\times(c/a)-(19/6)$.

The formula denoting the composition of the principal phase and formula (3) given above indicate that the value of w is increased in general with increase in the value of c/a. In other words, the concentration of T in the composition of the principal phase is increased with increase in the value of the ratio c/a so as to increase the saturation magnetic flux density. Where the ratio c/a exceeds 0.85, the concentration of the sum of Co and Fe in the $TbCu_7$ phase is considered to be at least 90 atomic percent.

When it comes to a binary compound consisting of Fe and a rare earth element of Nd, a $TbCu_7$ phase can be formed in some cases by subjecting the binary compound to a rapid cooling treatment with liquid. In the case of manufacturing the particular binary compound by the conventional method, however, the ratio c/a in the formed $TbCu_7$ phase is 0.83 to 0.85. In other words, it is difficult to form in the binary compound a $TbCu_7$ phase containing at least 90 atomic percent of Fe, resulting in failure to manufacture a magnetic material having a high saturation magnetic flux density.

On the other hand, the present inventors have successfully formed a $TbCu_7$ phase containing at least 90 atomic percent of a transition metal such as Fe by substituting an element having a smaller atomic radius such as Zr for the rare earth element, arriving at a magnetic material having a high saturation magnetic flux density. The particular magnetic material is disclosed in U.S. patent application Ser. No. 07/961,821 filed on Oct. 16, 1992. However, where the rare earth element is partly replaced by another element such as Zr, the amount of the rare earth element in the magnetic material is relatively lowered, with the result that the magnetic anisotropy of the magnetic material is not necessarily satisfactory.

To overcome the difficulty noted above, the present inventors have further continued the research, finding that Co greatly contributes to the promotion in the total concentration of Fe and Co in the $TbCu_7$ phase. For example, where Fe in the Nd—Fe binary compound referred to previously is partly replaced by Co, the ratio c/a has been found to exceed 0.86. In other words, the principal phase of the resultant magnetic material has been found to contain at least 90 atomic percent of Co and Fe.

As described above, the Co addition produces an effect of enabling the principal phase of the magnetic material to contain at least 90 atomic percent of Fe and Co, with the result that the magnetic material is enabled to exhibit a high saturation magnetic flux density. In addition, an element such as Zr, which serves to partly replace the rare earth element, is not used in the magnetic material of the present invention. In other words, the magnetic material of the present invention contains a sufficiently large amount of a rare earth element and, thus, exhibits an excellent magnetic anisotropy.

To be more specific, where the sum of Fe and Co in the principal phase having a $TbCu_7$ crystal structure is at least 90 atomic percent based on the total amount of the principal phase, the saturation magnetic flux density of the principal phase is as high as at least 1.62 T. For example, a $TbCu_7$ phase having a composition of $Sm_{8.5}Co_{27.4}Fe_{64.1}$ exhibits a saturation magnetic flux density of 1.70 T, a magnetic anisotropy of $4.1\times10^6 J/m^3$, and a Curie temperature of at least 600° C.

According to the second aspect of the present invention, there is provided a magnetic material which is represented by a general formula:

$$R_xR_zCo_yFe_{100-x-y-z} \quad (II)$$

where R is at least one element selected from the rare earth elements; A is at least one element selected from H, N, C and P; x, y and z are atomic percent individually defined as $4\leqq x\leqq 20$, $0.01\leqq y\leqq 20$, $z\leqq 20$; and Co and Fe occupy 90 atomic percent or more of all the elements except A in the principal phase of the compound.

As in the magnetic material according to the first aspect of the present invention, the term "principal phase" noted above denotes any of the crystal phases and amorphous phase that occupies the largest volume in the compound of the formula noted above. It is desirable for the principal phase to have a uniaxial crystal structure such as a hexagonal or tetragonal system. Particularly, the principal phase should desirably have a $TbCu_7$ crystal structure.

As apparent from general formula (II), the magnetic material according to the second phase of the present invention contains the rare earth element R, Co and Fe in the same amounts as in the magnetic material represented by general formula (I). The functions of these components of the magnetic material are as described previously in conjunction with the magnetic material according to the first aspect of the present invention.

The magnetic material of formula (II) further contains component A, which is selected from the group consisting of H, N, C and P, in an amount of 20 atomic percent or less. The component A, which is mainly present in the interstitial position of the $TbCu_7$ crystal structure, serves to improve the Curie temperature of the principal phase as well as the saturation magnetic flux density and the magnetic anisotropy of the magnetic material, compared with the magnetic material which does not contain the component A. If the amount of component A exceeds 20 atomic percent, it is difficult to form the $TbCu_7$ phase. Preferably, the amount of component A should be 10 atomic percent or less.

In the second aspect of the present invention, it is possible for Fe contained in the magnetic material to be partly replaced by at least one element M which is selected from the group consisting of Ti, Cr, V, Mo, W, Mn, Ni, Sn, Ga, Al, Ag, Cu, Zn, Nb and Ta. Where Fe is partly replaced by the element M, the principal phase is enabled to occupy a greater portion of the entire magnetic material. At the same time, it is possible to increase the total concentration of Fe, Co and M in the principal phase of the magnetic material. It should be noted, however, that, if Fe is replaced in an unduly large amount by the element M, the saturation magnetic flux density of the resultant magnetic material is lowered. To avoid the difficulty, it is desirable to set the substituting amount of the element M at 20 atomic percent or less based on the amount of Fe.

The principal phase of the magnetic material contains Co and Fe. It should be noted that the sum of Co and Fe in the principal phase should be at least 90 atomic percent based on the total amount of the principal phase except the element A. If the sum of Co and Fe in the principal phase is less than 90 atomic percent based on the total amount of the principal phase except the element A, it is impossible to obtain a magnetic material having a high saturation magnetic flux density. Particularly, it is desirable for Fe to occupy at least 25 atomic percent, more preferably at least 50 atomic percent, and most preferably 60 to 80 atomic percent, based on the sum of Co and Fe contained in the principal phase. Where Fe is contained in a large amount in the principal phase, the resultant magnetic material is enabled to exhibit a further increased saturation magnetic flux density.

It is unavoidable for traces of impurities such as oxides to be contained in the magnetic material represented by general formula (II). Of course, the magnetic material containing such unavoidable impurities is covered by the technical scope of the present invention.

The magnetic material of the present invention represented by general formula (II) can be manufactured as in the manufacture of the magnetic material represented by general formula (I), which was already described herein previously. In the case of using nitrogen as the element A contained in the magnetic material represented by general formula (II), the powdery magnetic material described previously in conjunction with the manufacture of the magnetic material represented by general formula (I) is subjected to a nitriding treatment, i.e., a heat treatment, at a temperature of 300° to 800° for 0.1 to 100 hours under a nitrogen gas atmosphere of 0.001 to 10 atms. A gaseous nitrogen compound such as ammonia can be used in place of the nitrogen gas for the heat treatment noted above. It is desirable to set the partial pressure of the nitrogen gas or the nitrogen compound gas to fall within a range of between 0.001 and 10 atms. Also, a gas which does not contain nitrogen may be added to the nitrogen gas or the nitrogen compound gas for carrying out the nitriding treatment. In the case of adding an oxygen-containing gas, however, it is desirable to set the partial pressure of the oxygen gas at a level not exceeding 0.02 atm. so as to avoid formation of oxides during the heat treatment, said oxide formation leading to deterioration in the magnetic characteristics of the resultant magnetic material.

It is also possible to use as the starting material a nitrogen compound such as RN, where R denotes the rare earth element defined in general formula (II), in the process of preparing the powdery magnetic material. In this case, the starting materials are subjected to a solid phase reaction described previously so as to enable the resultant material to contain nitrogen as the element A which is included in general formula (II).

Further, it is possible to apply a heat treatment to the powdery magnetic material prior to the nitriding treatment. In this case, the heat treatment should be carried out at a temperature of 300° to 1000° C. for 0.1 to 100 hours under an inert gas atmosphere or under vacuum. The heat treatment applied in this fashion permits markedly improving the coercive force of the resultant magnetic material.

A permanent magnet such as a bond magnet can be manufactured by using the magnetic material of the present invention represented by general formula (II). The manufacturing method described previously in conjunction with the manufacture of a permanent magnet using the magnetic material of general formula (I) can also be employed in the case of using the magnetic material of general formula (II).

As described previously, the magnetic material according to the second aspect of the present invention is represented by general formula (II), i.e., $[R_xA_zCo_yFe_{100-x-y-z}]$. What should be noted in particular is that the sum of Fe and Co contained in the principal phase of the magnetic material occupy at least 90 atomic percent of the total amount of the principal phase except the element A contained in the principal phase, leading to excellent magnetic characteristics of the magnetic material. To be more specific, the magnetic material exhibits marked improvements in its saturation magnetic flux density, magnetic anisotropy and Curie temperature. In other words, Fe contained in the rare earth-Fe series compound described previously is partly replaced by Co in the magnetic material of the present invention so as to enable the sum of Fe and Co contained in the principal phase of the magnetic material to occupy at least 90 atomic percent of the total amount of the principal phase.

The present inventors have found that, where the principal phase of a magnetic material has a $TbCu_7$ crystal structure, a magnetic material exhibiting excellent magnetic properties can be obtained by allowing the principal phase of the magnetic material to contain the element A, which is at least one element selected from the group consisting of H, N, C and P. The element A is located mainly in the interstitial position of the $TbCu_7$ phase so as to increase the distance between the magnetic atoms of Fe and Co, leading to improvements in the Curie temperature and saturation magnetic flux density of the magnetic material.

Further, the element A entering the $TbCu_7$ phase affects the 4f electron wave function of the element R contained in the $TbCu_7$ phase so as to further improve the magnetic anisotropy of the magnetic material.

Specifically, where the principal phase contains the element A and has a $TbCu_7$ crystal structure, it is important for the sum of Fe and Co to be at least 90 atomic percent based on the total amount of the principal phase excluding the amount of the element A. In this case, the saturation magnetic flux density of the principal phase is as high as at least 1.58 T. For example, a $TbCu_7$ phase having a composition of $Sm_{7.9}N_{6.4}Co_{25.7}Fe_{60.0}$ exhibits a saturation magnetic flux density of 1.62 T, a magnetic anisotropy of 9.7×106J/m$^3$, and a Curie temperature of at least 600° C.

Let us describe preferred Examples of the present invention.

EXAMPLE 1

A high purity powdery mixture of Sm, Co and Fe containing 12 atomic percent of Sm, 18 atomic percent of Co and the balance of Fe was subjected to an arc melting to prepare an ingot. The resultant ingot was melted under an argon gas atmosphere, followed by spraying the melt onto the surface of a copper roll having a diameter of 300 mm and rotating at a speed of 40 m/s so as to rapidly cool the melt and, thus, to obtain an alloy ribbon.

The alloy ribbon thus obtained was analyzed by a powder X-ray diffraction using a CuKα ray so as to obtain a diffraction pattern similar to that shown in FIGURE. The diffraction peaks in the resultant diffraction pattern except α-(Fe, Co) were indexed by a $TbCu_7$ crystal structure so as to obtain a lattice constant ratio (c/a) of the particular crystal phase. The ratio c/a was found to be 0.868, which suggested that the sum of Fe and Co in the $TbCu_7$ phase would be 91.5 atomic percent. As a matter of fact, the sum of Fe and Co in the $TbCu_7$ phase measured by the TEM analysis of the alloy ribbon was found to be 91.3 atomic percent.

The alloy ribbon prepared by the rapid cooling was subjected to a heat treatment at 700° C. for 15 minutes, followed by pulverization so as to obtain a powdery magnetic material having an average particle diameter of 60 μm. Then, 2% by weight of an epoxy resin was added to the powdery magnetic material. After a sufficient mixing, the resultant mixture was subjected to a compression molding under a pressure of 800 MPa, followed by applying a curing treatment to the molded material at 150° C. for 2.5 hours so as to obtain a bond magnet.

The resultant bond magnet was found to exhibit under room temperature a residual magnetic flux density of 0.58 T, a coercive force of 440 kA/m and a maximum energy product of 60 kJ/cm$^3$.

EXAMPLES 2 to 6

Five kinds of alloy ribbons were prepared by a rapid cooling method as in Example 1 by using predetermined amounts of high purity metals of Nd, Pr, Sm, Co, Fe, Ti, Cr, V and Mo. The composition of each alloy ribbon thus prepared was analyzed by a composition analysis. The crystal structure of the principal phase in each alloy ribbon was analyzed by a powder X-ray diffraction. Further, the sum of Co and Fe contained in the principal phase in each alloy ribbon was measured by a TEM analysis. Where Fe was partly replaced by another element, the sum noted above includes the amount of the substituting element. The results are shown in Table 1.

An X-ray diffraction pattern similar to that shown in FIGURE was obtained for each alloy ribbon, indicating that the principal phase in each of the alloy ribbons had a $TbCu_7$ crystal structure.

Then, each alloy ribbon was subjected to a heat treatment under vacuum at 600° C. for 15 minutes, followed by pulverization to obtain five kinds of powdery magnetic materials each having an average particle diameter of 60 μm. Further, five kinds of bond magnets were manufactured as in Example 1 using the powdery magnetic materials thus obtained. Table 1 also shows the residual magnetic flux density, coercive force and maximum energy product of each bond magnet under room temperature.

TABLE 1

| Examples | Composition (bal donates "balance") | Sun of T* in principal phase (atom %) | Residual magnetic flux density (T) | Coercive force (kA/m) | Maximum Energy Product (kJ/m$^3$) |
|---|---|---|---|---|---|
| 2 | $Nd_3Sm_{12}Ti_1Co_{12}$Febal | 91.2 | 0.58 | 464 | 56.0 |
| 3 | $Nd_5Sm_{10}V_2Co_{15}$Febal | 90.8 | 0.57 | 440 | 56.0 |
| 4 | $Pr_5Sm_9Cr_2Co_{12}$Febal | 90.5 | 0.59 | 456 | 60.8 |
| 5 | $Sm_{10}Nd_2Pr_2Co_{12}$Febal | 90.9 | 0.58 | 440 | 60.0 |
| 6 | $Sm_{12}Mo_2Co_{14}$Febal | 91.0 | 0.60 | 416 | 58.4 |

*T in the principal phase denotes the sum of Co and Fe. Where Fe is partly replaced by another element, T denotes the sum of Co, Fe and the substituting element.
In Example 2, T denotes the sum of Co, Fe and Ti.
In Example 3, T denotes the sum of Co, Fe and V.
In Example 4, T denotes the sum of Co, Fe and Cr.
In Example 6, T denotes the sum of Co, Fe and Mo.

EXAMPLE 7

A high purity powdery mixture of Sm, Co and Fe containing 14 atomic percent of Sm, 15 atomic percent of Co and the balance of Fe was melted, and the resultant molten mixture was sprayed onto a rotating roll as in Example 1 so as to form an alloy ribbon by a rapid cooling method. Then, the alloy ribbon was subjected to a heat treatment at 700° C. for 15 minutes under vacuum, followed by pulverization so as to obtain a powdery material having an average particle diameter of 30 μm. Further, a nitriding treatment was applied to the powdery material under a nitrogen gas atmosphere of 1 atm. at 460° C. for 6 hours so as to obtain a powdery magnetic material.

The resultant powdery magnetic material was found to consist of 8 atomic percent of Sm, 17 atomic percent of Co, 8 atomic percent of N, and the balance of substantially Fe.

A bond magnet was manufactured using the resultant powdery magnetic material as in Example 1. The bond magnet thus manufactured was found to exhibit a residual magnetic flux density of 0.65 T, a coercive force of 744 kA/m, and a maximum energy product of 65.6 kJ/m$^3$.

EXAMPLES 8 to 10

Three kinds of alloy ribbons were prepared by a rapid cooling method as in Example 1 by using predetermined amounts of high purity metals of Nd, Pr, Sm, Co, Fe, Ti, Cr, V and Mo. Then, a heat treatment was applied to each of the alloy ribbons thus prepared under vacuum at 600° C. for 15 minutes, followed by pulverization to obtain a powdery material having an average particle diameter of 35 μm. Further, a nitriding treatment was applied to each powdery alloy as in Example 7.

The composition of each powdery alloy thus prepared was analyzed by a composition analysis. The crystal structure of the principal phase in each powdery alloy was analyzed by a powder X-ray diffraction. Further, the sum of Co and Fe contained in the principal phase in each powdery alloy was measured by a TEM analysis. Where Fe was partly replaced by another element, the sum noted above includes the amount of the substituting element. The results are shown in Table 2.

An X-ray diffraction pattern similar to that shown in FIGURE was obtained for each alloy ribbon, indicating that the principal phase in each of the alloy ribbons had a $TbCu_7$ crystal structure.

Three kinds of bond magnets were manufactured as in Example 1 using the powdery magnetic materials thus obtained. Table 2 also shows the residual magnetic flux density, coercive force and maximum energy product of each bond magnet under room temperature.

TABLE 2

| Examples | Composition (bal donates "balance") | Sun of T* in principal phase (atom %) | Residual magnetic flux density (T) | Coercive force (kA/m) | Maximum Energy Product ($kJ/m^3$) |
|---|---|---|---|---|---|
| 2 | $Nd_8Sm_2Ti_2V_2N_8Co_{12}Febal$ | 90.6 | 0.66 | 744 | 64.8 |
| 3 | $Pr_7Sm_3Mo_2N_7Co_{11}Febal$ | 90.8 | 0.63 | 728 | 64.0 |
| 4 | $Nd_8Sm_2N_9Co_{10}Febal$ | 91.1 | 0.65 | 728 | 64.8 |

*T in the principal phase denotes the sum of Co and Fe. Where Fe is partly replaced by another element, T denotes the sum of Co, Fe and the substituting element.
In Example 8, T denotes the sum of Co, Fe and Ti.
In Example 9, T denotes the sum of Co, Fe and Mo.

EXAMPLES 11 to 15

Five kinds of alloy ribbons were prepared by a rapid cooling method as in Example 1 by using predetermined amounts of high purity metals of Nd, Pr, Sm, Co, Fe, W, Sn, Cu, Mn, Ag, Nb, Ti, Ga, Ni, Mo, Al, Ta and C. Then, a heat treatment was applied to each of the alloy ribbons thus prepared under vacuum at 600° C. for 15 minutes, followed by pulverization to obtain a powdery material having an average particle diameter of 35 μm. Further, a nitriding treatment was applied to each powdery alloy as in Example 7.

The composition of each powdery alloy thus prepared was analyzed by a composition analysis. The crystal structure of the principal phase in each powdery alloy was analyzed by a powder X-ray diffraction. Further, the sum of Co and Fe contained in the principal phase in each powdery alloy was measured by a TEM analysis. Where Fe was partly replaced by another element, the sum noted above includes the amount of the substituting element. The results are shown in Table 3.

An X-ray diffraction pattern similar to that shown in FIGURE was obtained for each alloy ribbon, indicating that the principal phase in each of the alloy ribbons had a $TbCu_7$ crystal structure.

Five kinds of bond magnets were manufactured as in Example 1 using the powdery magnetic materials thus obtained. Table 3 also shows the residual magnetic flux density, coercive force and maximum energy product of each bond magnet under room temperature.

Controls 1 and 2

Two kinds of alloy ribbons were prepared by a rapid cooling method as in Example 1 by using predetermined amounts of high purity metals of Nd, Sm, Zr, Fe, and Co. Then, a heat treatment was applied to each of the alloy ribbons thus prepared under vacuum at 600° C. for 15 minutes, followed by pulverization to obtain a powdery material having an average particle diameter of 35 μm.

The composition of each powdery alloy thus prepared was analyzed by a composition analysis. The crystal structure of the principal phase in each powdery alloy was analyzed by a powder X-ray diffraction. Further, the sum of Co and Fe contained in the principal phase in each powdery alloy was measured by a TEM analysis. The results are shown in Table 4.

An X-ray diffraction pattern similar to that shown in FIGURE was obtained for each alloy film, indicating that the principal phase in each of the powdery alloy had a $TbCu_7$ crystal structure.

Two kinds of bond magnets were manufactured as in Example 1 using the powdery magnetic materials thus obtained. Table 4 also shows the residual magnetic flux density, coercive force and maximum energy product of each bond magnet under room temperature.

TABLE 3

| Examples | Composition (bal donates "balance") | Sun of T* in principal phase (atom %) | Residual magnetic flux density (T) | Coercive force (kA/m) | Maximum Energy Product ($kJ/m^3$) |
|---|---|---|---|---|---|
| 11 | $Nd_3Sm_8W_2Sn_1Cu_1N_7Co_{18}Febal$ | 90.5 | 0.63 | 735 | 63.9 |
| 12 | $Nd_3Sm_6Mn_1Ag_1Nb_1N_8C_1Co_{15}Febal$ | 90.7 | 0.62 | 729 | 63.8 |
| 13 | $Sm_8Ti_2Ga_1Ni_3N_5Co_{16}Febal$ | 91.2 | 0.60 | 733 | 63.5 |
| 14 | $Sm_9Mo_2Al_2Ta_1C_2N_5Co_{15}Febal$ | 90.7 | 0.63 | 740 | 64.0 |
| 15 | $Nd_2Sm_7Nb_1Ga_2N_7Co_{20}Febal$ | 90.3 | 0.62 | 742 | 63.9 |

*T in the principal phase denotes the sum of Co and Fe. Where Fe is partly replaced by another element, T denotes the sum of Co, Fe and the substituting element.
In Example 11, T denotes the sum of Co, Fe, W, Sn and Cu.
In Example 12, T denotes the sum of Co, Fe, Mn Ag and Nb.
In Example 13, T denotes the sum of Co, Fe, Ti Ga and Ni.
In Example 14, T denotes the sum of Co, Fe, Mo, Al and Ta.
In Example 15, T denotes the sum of Co, Fe, Nb and Ga.

TABLE 4

| Controls | Composition (bal donates "balance") | Sun of T* in principal phase (atom %) | Residual magnetic flux density (T) | Coercive force (kA/m) | Maximum Energy Product ($kJ/m^3$) |
|---|---|---|---|---|---|
| 1 | $Nd_5Sm_4$Febal | 88.3 | 0.05 | 16 | 0.8 or less |
| 2 | $Sm_1Zr_7Co_{15}$Febal | 90.5 | 0.30 | 240 | 0.8 or less |

*T in the principal phase denotes Fe or the sum of Co and Fe.

AS apparent from Tables 1 to 3 and Examples 1 and 7, the bond magnets obtained in Examples 1 to 15 exhibited excellent magnetic characteristics. It should be noted in this connection that the bond magnet obtained in each of Examples 1 to 7 was prepared by using a powdery magnetic material and an epoxy resin. The sum of Fe and Co contained in the principal phase, which had a $TbCu_7$ crystal structure, of the magnetic material was 90 atomic percent based on the total amount of the principal phase. As a result, the saturation magnetic flux density of the principal phase was as high as at least 1.62 T, leading to manufacture of the bond magnets having excellent magnetic properties noted above. On the other hand, the bond magnet obtained in each of Examples 8 to 15 was prepared by using a powdery magnetic material and an epoxy resin. The sum of Fe and Co contained in the principal phase, which had a $TbCu_7$ crystal structure containing an element A such as N or C, of the magnetic material was at least 90 atomic percent based on the total amount of the principal phase excluding the element A. As a result, the saturation magnetic flux density of the principal phase was as high as at least 1.58 T, leading to manufacture of the bond magnets having excellent magnetic characteristics noted above.

Table 4 also shows that the bond magnet for Control 2 was low in its coercive force. It should be noted that Zr partly replacing the rare earth elements of Nd and Sm was contained in a large amount in the powdery magnetic material used for manufacturing the bond magnet for Control 2, leading to reduction in the amount of the rare earth elements contained in the bond magnet. This is considered to have brought about reduction in the magnetic anisotropy of the bond magnet, leading to the low coercive force noted above.

As described above, the present invention provides a magnetic material exhibiting a high saturation magnetic flux density and excellent in its magnetic anisotropy. Naturally, the magnetic material of the present invention is adapted for the manufacture of a permanent magnet, e.g., a bond magnet.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A magnetic material which is represented by a general formula:

$$R_xCo_yFe_{100-x-y} \quad (I)$$

where R is at least one element selected from the rare earth elements, x and y are atomic percent individually defined as $4 \leqq x \leqq 20$ and $0.01 \leqq y \leqq 70$, and Co and Fe occupy 90 atomic percent or more in a principal phase wherein said principal phase has a volume larger than any other crystal phases or amorphous phase in said magnetic material, and said principal phase has a $TbCu_7$ crystal structure at a temperature of 700° C. or less.

2. The magnetic material according to claim 1, wherein x in said general formula (I) is defined by $4 \leqq x \leqq 16$.

3. The magnetic material according to claim 1, wherein y in said general formula (I) is defined by $4 \leqq y \leqq 40$.

4. The magnetic material according to claim 1, wherein y in said general formula (I) is defined by $10 \leqq y \leqq 40$.

5. The magnetic material according to claim 1, wherein said magnetic material represented by general formula (I) contains Fe in an amount of between 70 and 95.09 atomic percent.

6. The magnetic material according to claim 1, wherein Fe contained in the principal phase occupies at least 25 atomic percent based on the sum of Co and Fe contained in the principal phase.

7. The magnetic material according to claim 1, wherein Fe contained in the principal phase occupies at least 50 atomic percent based on the sum of Co and Fe contained in the principal phase.

8. The magnetic material according to claim 1, wherein Fe contained in the principal phase occupies 60 to 80 atomic percent based on the sum of Co and Fe contained in the principal phase.

9. The magnetic material according to claim 1, wherein Fe in the magnetic material represented by general formula (I) is partly replaced by M in an amount of at most 20 atomic percent based on the total amount of Fe contained in the magnetic material represented by general formula (I), wherein said M is at least one element selected from the group consisting of Ti, Cr, V, Mo, W, Mn, Sn, Ag, Cu, Ni, Ga, Al, Nb, and Ta.

10. A magnetic material which is represented by a general formula:

$$R_xA_zCo_yFe_{100-x-y-z} \quad (II)$$

where R is at least one element selected for the rare earth elements; A is at least one element selected from H, N, C and P; x, y and z are atomic percent individually defined as $4 \leqq x \leqq 20$, $0.01 \leqq y \leqq 20$, $z \leqq 20$; and Co and Fe occupy 90 atomic percent or more of all the elements except A in a principal phase wherein said principal phase has a volume larger than any other crystal phases or amorphous phase in said magnetic material, and said principal phase has a $TbCu_7$ crystal structure at a temperature of 700° C. or less.

11. The magnetic material according to claim 10, wherein x in said general formula (II) is defined by $4 \leqq x \leqq 16$.

12. The magnetic material according to claim 10, wherein y in said general formula (II) is defined by $4 \leqq y \leqq 20$.

13. The magnetic material according to claim 10, wherein y in said general formula (II) is defined by $10 \leqq y \leqq 20$.

14. The magnetic material according to claim 10, wherein z in said general formula (II) is defined by $0 < z \leqq 10$.

15. The magnetic material according to claim 10, wherein said magnetic material represented by general formula (II) contains Fe in an amount of between 70 and 95.09 atomic percent.

16. The magnetic material according to claim 10, wherein Fe contained in the principal phase occupies at least 25 atomic percent based on the sum of Co and Fe contained in the principal phase.

17. The magnetic material according to claim 10, wherein Fe contained in the principal phase occupies at least 50 atomic percent based on the sum of Co and Fe contained in the principal phase.

18. The magnetic material according to claim 10, wherein Fe contained in the principal phase occupies 60 to 80 atomic percent based on the sum of Co and Fe contained in the principal phase.

19. The magnetic material according to claim 10, wherein Fe in the magnetic material represented by general formula (II) is partly replaced by M in an amount of at most 20 atomic percent based on the total amount of Fe contained in the magnetic material represented by general formula (II), wherein said M is at least one element selected from the group consisting of Ti, Cr, V, Mo, W, Mn, Sn, Ag, Cu, Ni, Ga, Al, Nb, and Ta.

* * * * *

Disclaimer 5,456,769—Shinya Sakurada, Yokohama; Takahiro Hirai, Kamakura; Akihiko Tsutai, Kawasaki, all of Japan. MAGNETIC MATERIAL. Patent dated Oct. 10, 1995. Disclaimer filed Nov. 13, 1997, by the assignee, Kabushiki Kaisha Toshiba.

Hereby enters this disclaimer to all claims of said patent.

*(Official Gazette,* February 24, 1998)